US006719473B1

(12) United States Patent
Kao

(10) Patent No.: US 6,719,473 B1
(45) Date of Patent: Apr. 13, 2004

(54) LIGHT EMITTING PEN FOR ILLUMINATION AT NIGHT AND FOR WRITTING

(75) Inventor: Sheng-Hsiung Kao, Tauyuan (TW)

(73) Assignees: David Liu, Taipei (TW); Tien-Ta Lin, Taipei (TW)

( * ) Notice: Subject to any disclaimer, the term of this patent is extended or adjusted under 35 U.S.C. 154(b) by 0 days.

(21) Appl. No.: 10/284,528

(22) Filed: Nov. 1, 2002

(51) Int. Cl.[7] ..... B43K 29/00
(52) U.S. Cl. ..... 401/195; 401/52; 362/118
(58) Field of Search ..... 40/52, 192, 195; 362/118

(56) References Cited

U.S. PATENT DOCUMENTS 2,979,602 A * 4/1961 Barnett ..... 362/579
5,275,497 A * 1/1994 Shiau ..... 401/195
6,129,473 A * 10/2000 Shu ..... 401/195

* cited by examiner

*Primary Examiner*—Gregory L. Huson
*Assistant Examiner*—Peter deVore

(57) ABSTRACT

A light emitting pen emits light unidirectioanlly or bidirectionally. By pressing a press button, an upper light emitting unit or lower light emitting unit are controlled to light up or distinguished. Moreover, the rising and descending of the filler is controllable so that the pen head will protrude out or embedded into the pen tube. Thereby, at night, by the upper lower pen tube or lower light emitting unit to emit light, light emits so as to provide illumination for writing. When the two light emitting units do no light up, the pen head will embed into the pen tube for storage.

8 Claims, 8 Drawing Sheets

LIGHT EMITTING PEN FOR ILLUMINATION AT NIGHT AND FOR WRITTING

FIELD OF THE INVENTION

The present invention relates to pens, and particularly to light emitting pen A light emitting pen emits light unidirectioanlly or bidirectionally. By the present invention, at night the upper lower pen tube or lower light emitting unit emits light as to provide illumination for writing. When the two light emitting units do not light up, the pen head will embedded into the pen tube for storage.

BACKGROUND OF THE INVENTION

The prior art light emitting pen emits light unidirectionally, namely, a light emitting unit (for example, light emitting units, LED) is hidden within the pen. If this light emitting unit is at an upper end of the pen, then the light emitting pen can be used at night for illumination. If the light emitting unit is at a middle section of the pen, the pen can write at night. However, no pen can emit light bidirectionally for illumination and writing at night.

Furthermore, the prior art unidirectional light emitting unit has a button at a distal end for controlling the lighting of the pen and the movement of the filler is controlled by a lower pen tube so that the pen head can protrude out or embed into the pen tube. However, the controls of the filler and light emitting unit are performed by two mechanisms and thus it make a trouble to the users.

The U.S. Pat. No. 6,129,473 "PEN OR THE LIKE WITH DUAL ILLUMINATING ENDS" discloses a pen emitting light bidirectionally. The pen has an upper light emitting unit and a lower light emitting unit, however, in writing, the filler must press downwards upon the paper. Then the filler rises upwards to trigger a battery seat at an upper end of the light emitting pen so that the upper and lower light emitting units emit light, and vice versa. In this design, the pen head is exposed out of the pen tube, and can not reduce back automatically. Thereby, in general, a cover is necessary. The pen lights up when writing. Since it can not be used at night, it is used as an interesting design and suitable for children.

SUMMARY OF THE INVENTION

Accordingly, the primary object of the present invention is to provide a light emitting pen emits light unidirectioanlly or bidirectionally. By pressing a press button, an upper light emitting unit or a lower light emitting unit is controlled to light up or distinguished. Moreover, the rising and descending of the filler are controllable so that the pen head will protrude out or embedded into the pen tube. Thereby, at night, by the upper lower pen tube or lower light emitting unit to emit light, light emits so as to provide illumination for writing. When the two light emitting units do no light up, the pen head will embedded into the pen tube for storage.

To achieve above object, the present invention provides a light emitting pen emitting light bi-directionally comprising: an upper pen tube having an inner wall, an upper end of the inner wall having a guide; a lower pen tube mounted to a lower end of the upper pen tube; a battery seat in the upper pen tube; an upper end of the battery seat being installed with a guiding forward unit; a press button in the upper pen tube; a lower end of the press button having a guiding out unit; the battery seat being engaged with the press button and being in above said guide; a filler in the lower pen tube; and an expandable spring in the lower pen tube. A battery set is installed in the battery seat. A positive electrode and a negative electrode are in contact with metal bending pieces at an upper and a lower end of the battery seat; and the two metal bending pieces protrude out of the battery seat and then are bent as an L shape. Each of an upper and a lower ends of the battery seat are embedded with an upper light emitting unit and a lower light emitting unit, respectively. A short leg of each light emitting unit is in contact with one electrode of the battery set, and a long leg of each light emitting unit protrudes out of the battery seat and then is bent as an L shape to as to adhere to a wall of the battery seat. The long leg is aligned with, but not in contact with the two metal bending pieces; an inner wall of the upper pen tube has an axial groove. Thereby, a metal piece can be guided into the upper pen tube and then are fixed therein. When the battery seat rotates step by step so that when one of the short legs, long legs and the metal bending pieces is in contact with the metal piece of the upper pen tube, one of the upper pen tube or lower pen tube will light up. A pen head at a lower end of the filler protrudes out or embeds into the lower pen tube.

The various objects and advantages of the present invention will be more readily understood from the following detailed description when read in conjunction with the appended drawing.

BRIEF DESCRIPTION OF THE PREFERRED EMBODIMENTS

Figure 1:
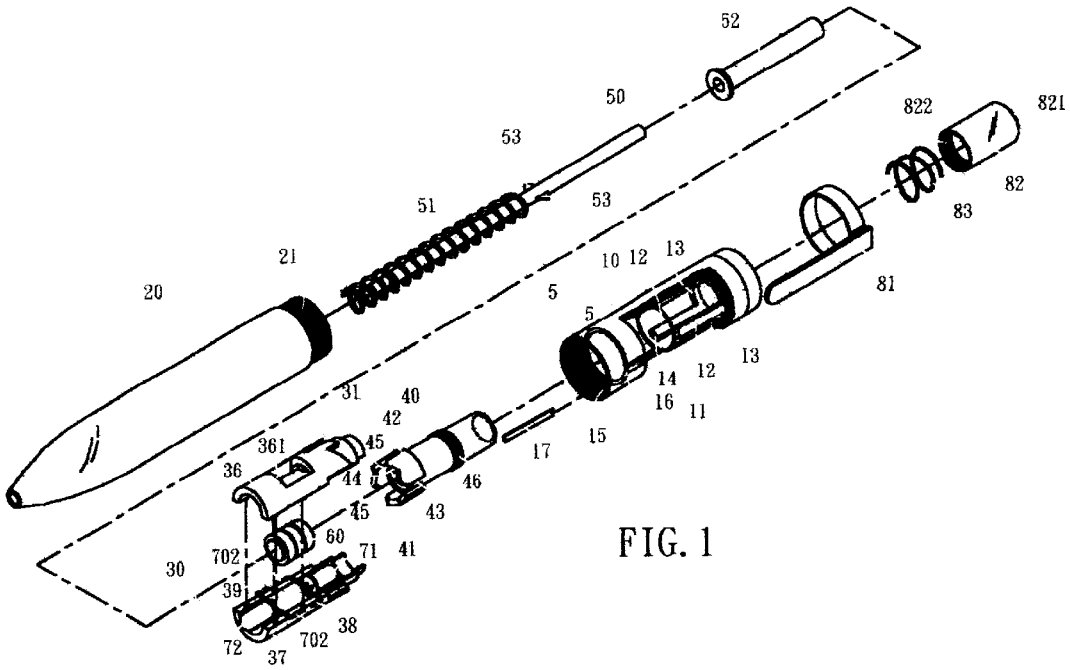
FIG. 1 is an exploded perspective view of the light emitting pen of the present invention.
Figure 2:
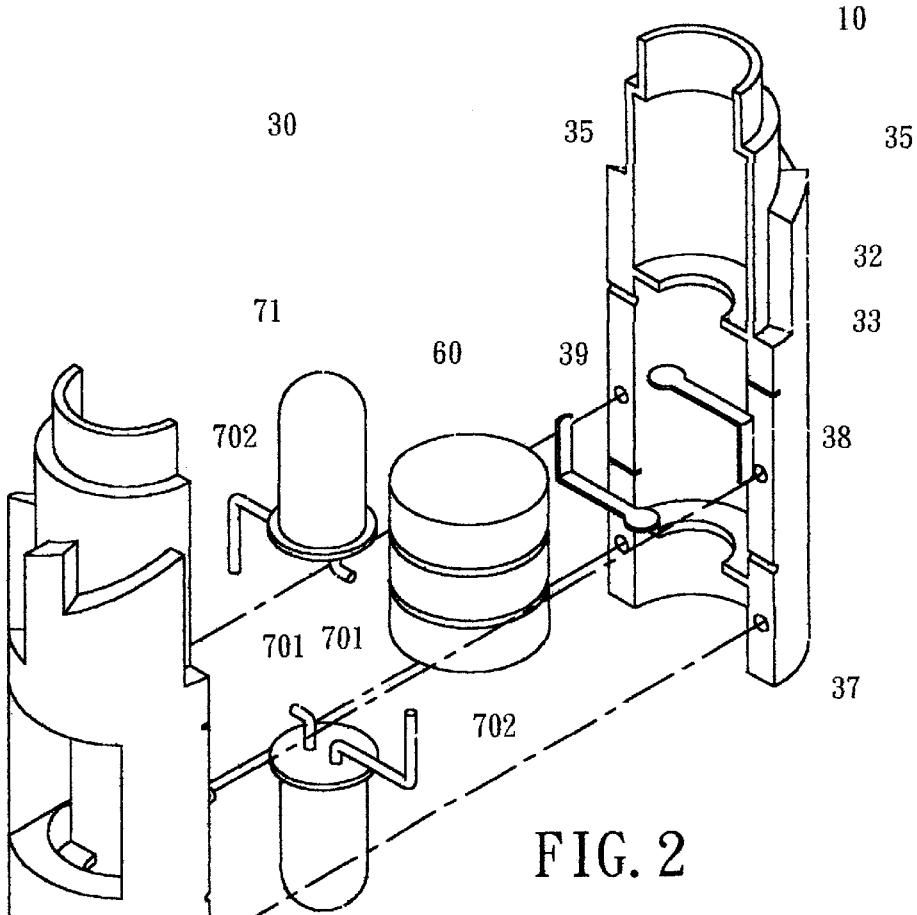
FIG. 2 is an exploded perspective view of the battery seat of the present invention.
Figure 3:
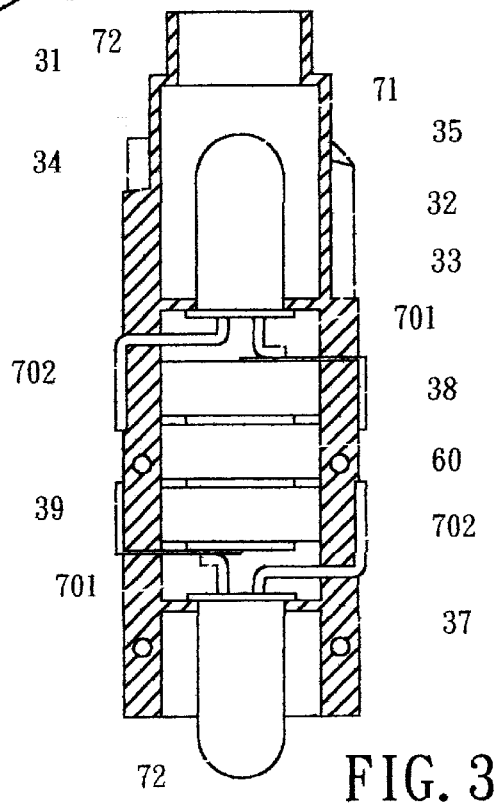
FIG. 3 is a cross sectional view of the battery seat of the present invention.
Figure 4:
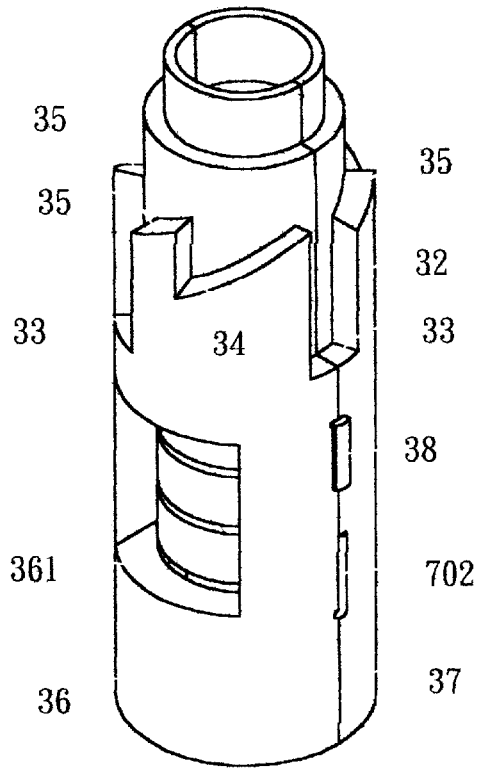
FIG. 4 is an assembled perspective view of the battery seat of the present invention.

Referring to FIG. 1, an exploded perspective view of the light emitting pen of the present invention is illustrated. The light emitting pen of the present invention includes an upper pen tube 10, a lower pen tube 20 combined to the upper pen tube 10; a battery seat 30 and a press button 40 installed in the upper pen tube 10; a filler 50 in the lower pen tube 20; and an expandable spring 51. An upper inner wall of the upper pen tube 10 has a guide 11. An upper end of the battery seat 30 is a guiding forward unit 31. A lower end of the press button 40 has a guiding out unit 41. The guiding forward unit 31 and guiding out unit 41 are engaged with one another and are installed within the guide 11. By pressing the press button 40, the guiding forward unit 31 and the guiding out unit 41 are moved in the guide 11 so that the battery seat 30 rotates step by step. The structure of the battery seat 30 is illustrated in FIG. 2. The battery seat 30 is formed by a half clip seat 36 and another half clip seat 37. Serially connected batteries 60 forming a battery set are installed in the battery seat 30. The positive and negative electrodes of the battery set 60 are in contact with the upper and lower metal bending pieces 38 and 39 (referring to FIG. 3). The two metal bending pieces 38 and 39 protrudes out of the battery seat 30 and then are bent as an L shape to touch the wall. An upper and a lower ends of the battery seat 30 are embedded with respective light emitting units 71, 72 which are preferably, light emitting diodes (LEDs). This is because LEDs has a small volume, lower power consumption, high illumination and long lifetime. Each of the light emitting units 71, 72 has a short leg 701 which is in contact with another electrode of the battery set 60 and has a long leg 702 protruding out of the battery seat 30 to be adhered on the wall of the battery seat 30 and having an L shape. The long legs 702 are aligned to the metal bending pieces 38 and 39, but not in contact to the metal bending pieces 38 and 39 (referring to FIG. 4). After the clip seat 36 and clip seat 37 are assembled, it is difficult to separate the two. To be near the battery set 60, a wall of one of the clip seat 36 is formed with a window. 361.

Moreover, the guiding forward unit 31 of the battery seat 30 has a prior art structure since the guiding forward unit 31 is formed by a plurality of blocks 32 which are spaced with an equal angle. A guide trench 33 is formed between two blocks. 32. A top of each block 32 is formed with an oblique ratchet 35 due to a triangular opaque slit 34.

Next, the guiding out unit 41 of the press button 40 has a prior art structure and is formed by a plurality of blocks 42 which are spaced with an equal angle. A trench is formed between two blocks 42. A lower end of each block 42 has a triangular slot 44 so as to form a ratchet 45.

Figure 5:
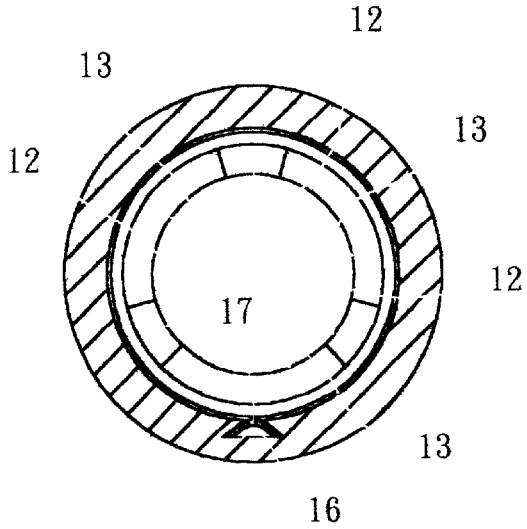
FIG. 5 is a cross sectional view along line 5—5 of the upper pen tube of FIG. 1.

Moreover, the guide 11 in the upper pen tube 10 of FIG. 1 has a prior art structure. The guide 11 is formed a plurality of convex strips 12. A track 13 is formed between the strips 12. A lower end of each strip 12 has an oblique tooth 14. The upper pen tube 10 is a plastic tube and is enclosed by a layer of metal wall. A top of the upper pen tube 10 can be covered by a pen clip 81. A lower end of the upper pen tube 10 can be screwed with the male thread 21 at a top of the lower pen tube 20 by the female thread 15 thereof. An axial groove 16 is formed at an inner wall of the upper pen tube 10 for guiding a metal piece 17 into the tube. A cross section of the groove 16 has a shape of a dovetail as illustrated in FIG. 5. Thereby, the metal piece 17 with a cambered shape is positioned fixedly after it is guided into the upper pen tube 10.

Besides, the lower pen tube 20 is a transparent plastic tube so that light can radiate into the lower pen tube 20. A filler 50 installed with a spring 51 can be installed in the tube. In a rear end of the filler 50, a hat resists against the spring 51. Then the hat 52 resists against the lower light emitting unit 72. If the filler 50 is a plastic filler, two symmetrical ears 53 can be punched from a wall of a middle portion of the filler (as shown in dashed line) for stopping a spring at a lower end of the filler 50. At this case, the hat 52 can be not used, but a lower end of the filler 50 resists against the light emitting unit 72.

Figure 6:
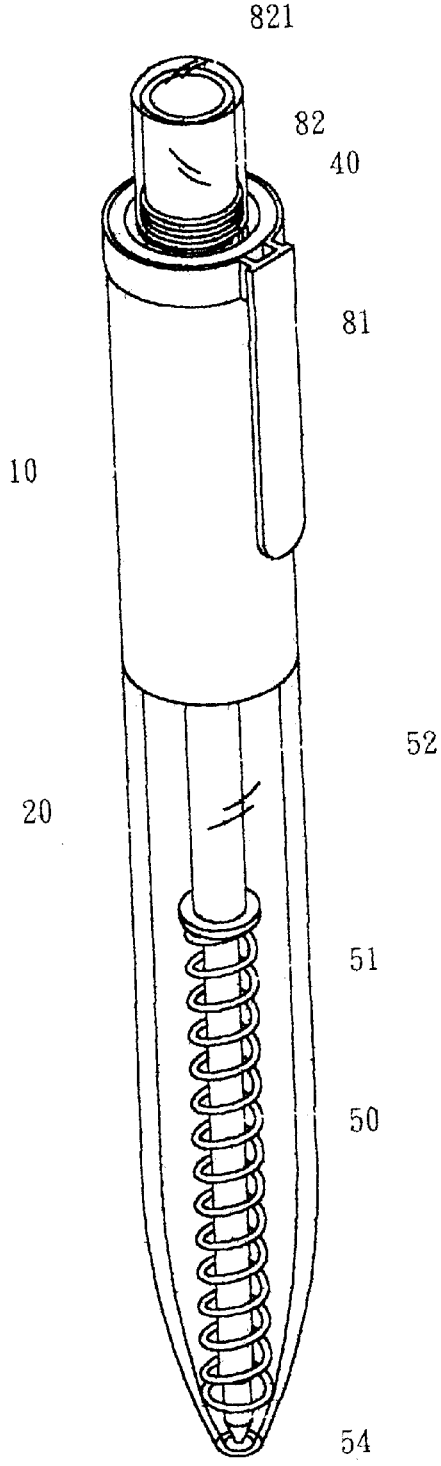
FIG. 6 is an assembled perspective view of the light emitting pen of the present invention.
Figures 7, 7A:
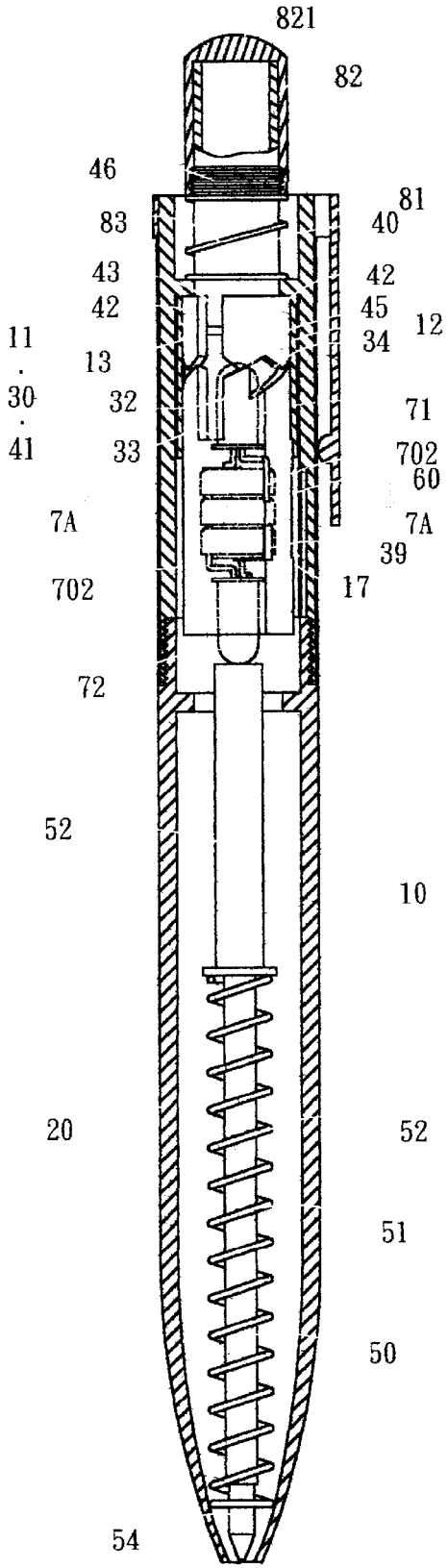
FIG. 7 is a cross sectional view showing that the light emitting pen does not light up and the pen head is the pen tube.
FIG. 7A is a schematic view along line 7A—7A of FIG. 7.

Furthermore, to shield a top the hollow tube shape press button 40, a transparent press cap 82 is installed, as shown in FIG. 6. A top of the press cap 82 is a convex lens 821, as shown in FIG. 7 for focusing light. In the pressing process, the press button 40 can move upwards automatically by the spring 51. To be quicker in the lifting process, an expandable spring 81 is installed between the block 42 and the press cap 82. To be fixed the press cap 82 not to fall down, a screw 822 is used to screw the tubular thread 46 of the press button 40.

A whole cross sectional view of the light emitting pen of the present invention is illustrated in FIG. 7. A lower end if the battery seat 30 resists against the filler 50 and an upper end thereof is engaged to the guiding out unit 41 of the press button 40 by the guiding forward unit 31. The guiding out unit 41 and guiding forward unit 31 are in the guide 11. Therefore, when the press button 40 is pressed by the user reciprocally, the guiding out unit 41 is lifted or descended in the guide 11 to enforce the guiding forward unit 31 to rotate. Thus the battery seat 30 rotates step by step. The rotating angle of the battery seat 30 in a step is determined by the ratchets 35 and 45 of the battery seat 30 and press button 40. The large the number of the teeth, the smaller the rotating angle, and vice versa.

In the embodiment of the present invention, each step has a 60 degrees. Technology about the step rotation of the battery seat 30 is a prior art and thus the details will not be described here. It can discover from the cross section of FIG. 7A, the metal legs 702, and metal pieces 38 and 39 are not in contact with the metal piece 17 in the inner wall of the upper pen tube 10. Thereby, the upper and lower light emitting units 71, 72 will not be powered and thus not emit light. At this moment, the filler 50 rises due to the expansion of the spring 51 and thus the head of the pen 54 will embed into the lower pen tube 20 so that the pen is suitable to be placed in the pocket.

Figure 8:
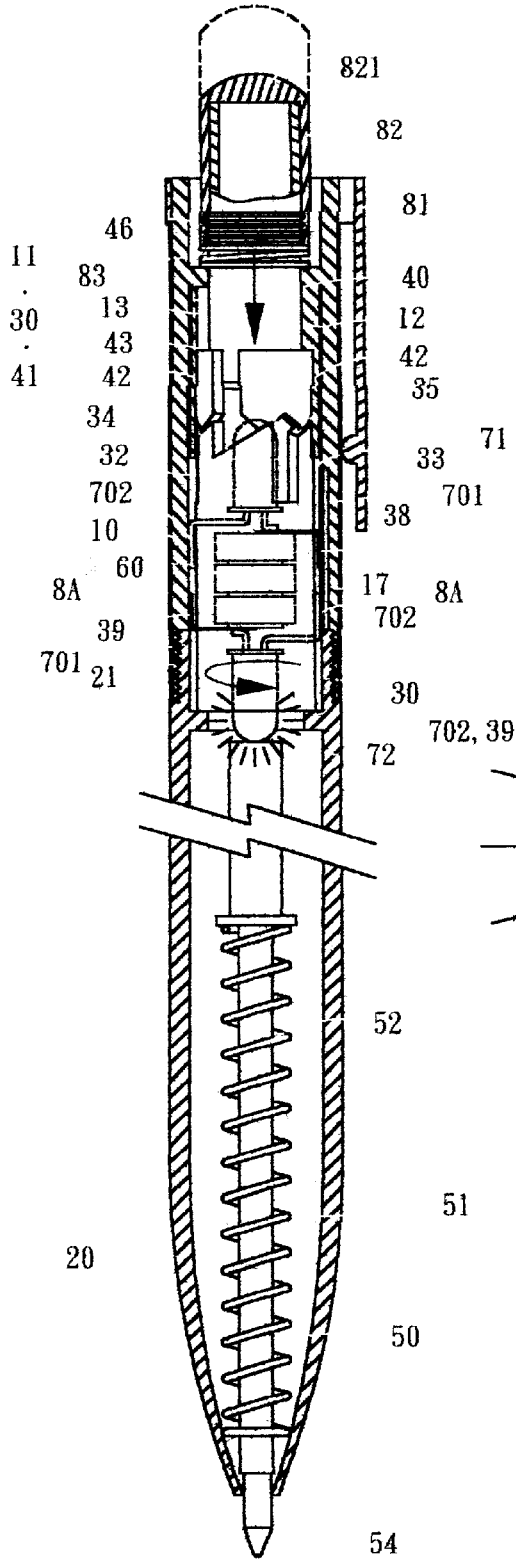
FIG. 8 is a cross sectional view showing the lower light emitting unit lights up and the pen head protrudes out.
Figure 8A:
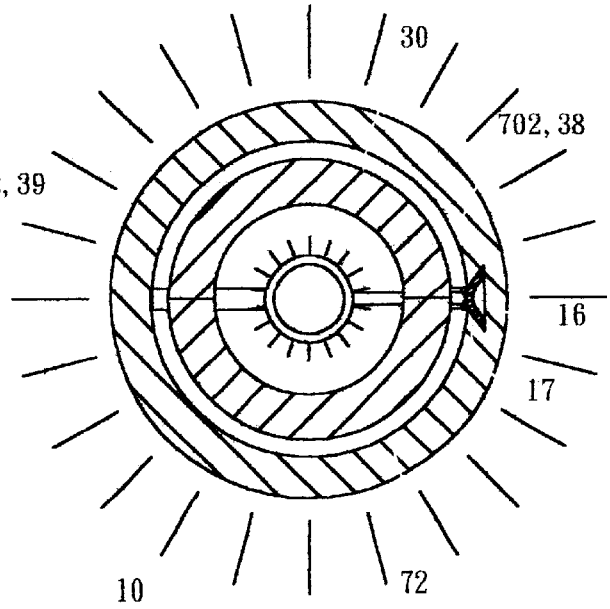
FIG. 8A is a cross sectional view along line 8A—8A of FIG. 8.

Referring to FIGS. 8 and 8A, when the battery seat 30 rotates to one of the metal legs 702 and metal piece 38, to be in contact with the metal piece 17, the negative current of the battery set 60 will be transferred to the lower light emitting unit 72. Another short leg 701 of the lower light emitting unit 72 is in contact with the positive electrode of the battery set 60, and thus the short leg 701 will be powered and then light is emitted. The light is radiated from the lower pen tube 20. At this time, the filler 50 is affected by the descending of the battery set 60 and thus the pen head 54 descends to protrude out of the lower pen tube 20. Thus, the light emitting pen of the present invention can be used at night.

Figure 9:
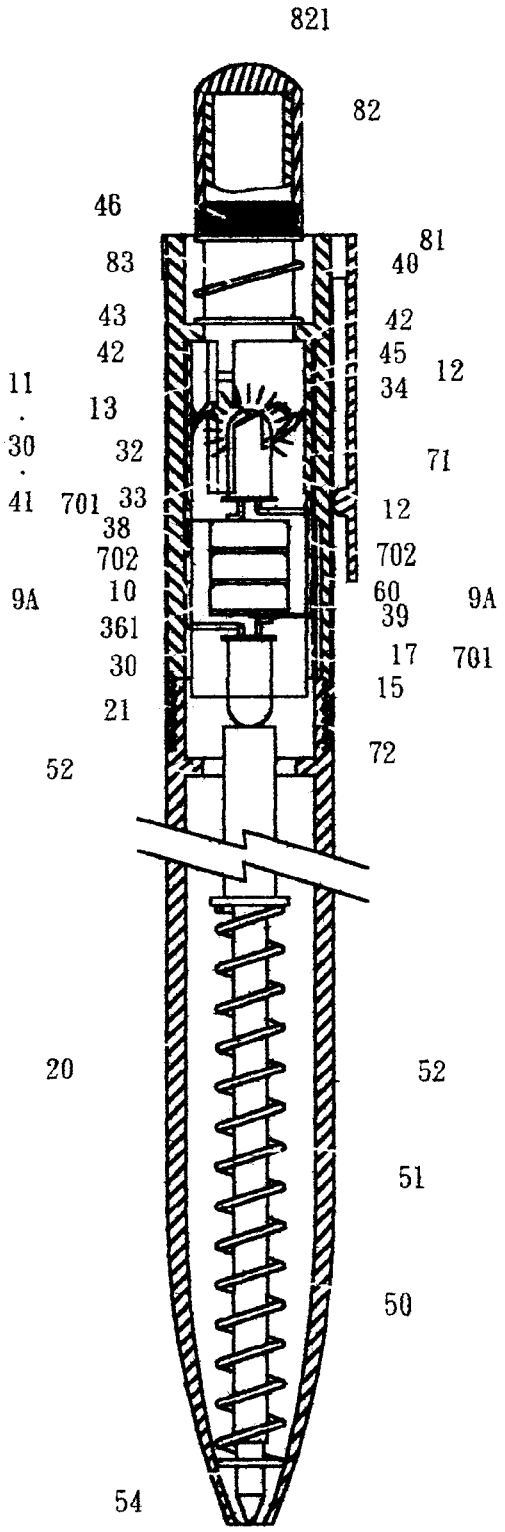
FIG. 9 is a cross sectional view showing that the pen head is embedded into the pen tube and the upper light emitting unit lights up.
Figure 9A:
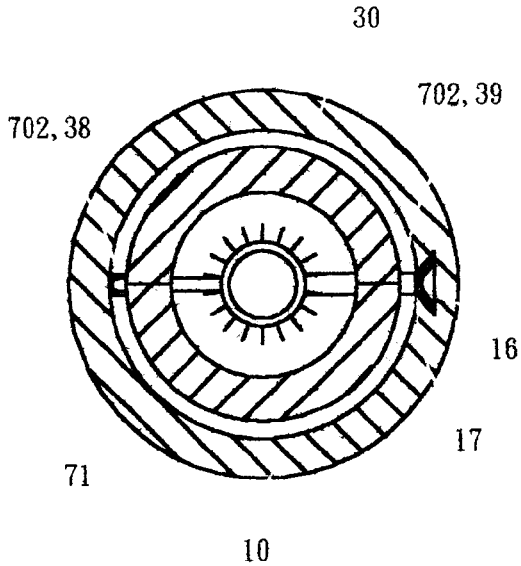
FIG. 9A shows the cross sectional view along line 9A—9A of FIG. 9.

Referring to FIGS. 9 and 9A, when the battery seat 30 rotates step by step so that the metal legs 702 and the metal pieces 39 are in contact with the metal piece. 17, the positive current of the battery set 60 will be conducted to the upper light emitting unit 71. Another short leg 701 of the upper light emitting unit 71 is in contact with the negative electrode of the battery set 60, the upper light emitting unit 71 is powered and emits light so that the light passes through the press button 40 to transmit out. If a top of the press button 40 is installed with a press cap 52, the light is focused by a convex lens 821 and thus it is suitable at night. At this time, the battery seat 30 has moved upwards, the pen head 54 is embedded into the lower pen tube 20.

The rising and descending of the filler 50 will be described here. When the press button 40 is pressed downwards, the battery seat 30 descends. When the ratchet 35 of the battery seat 30 is stopped by the oblique teeth 14 of the upper pen tube 10, the battery seat 30 can not rise to be pulled backwards even the spring 51 of the filler 50 expands again. Therefore, the filler 50 is affected by the descending of the battery seat 30 so that the pen tube 54 protrudes out of the lower pen tube 20. When the press button 40 is pressed again so that the battery seat 30 descends, the battery seat 30 is guided into the track 13 by the expansion of the spring 51 of the filler 50 and the blocks 32. As a result, the battery seat 30 rises automatically toward the original position and at this time, the filler 50 rises by the expansion of the spring 51. Then, the pen head 54 is embedded into the lower pen tube 20. The rising and descending of the filler 50 are used in the prior art and thus the details will not be described here. However, the filler 50 and battery seat 30 are installed in the pen tube and are controlled by the press button 40 to light up or extinguish. The operation of the pen head is a novel design of the present invention.

In the present invention, if the press button 40 is pressed so that the battery seat 30 has six steps in step rotation (each step has a coverage of 60 degrees), then the light emitting unit and the pen head experiences the following steps: 1. The pen head protrudes . 2 The pen head merges into the pen body. 3. The pen head protrudes out and the lower light emitting unit emits light. 4. The pen head embeds into the pen body. 4. The pen head protrudes out. 6. The pen head embeds into the pen body and the upper light emitting unit emits light. 1. The pen head protrudes out. In above steps 1, 2, 4, and 5, the upper and lower light emitting units 71, 72 do not radiate light. Only at steps 3 and 6, the upper and lower light emitting units 71, 72 emit light.

Figure 10:
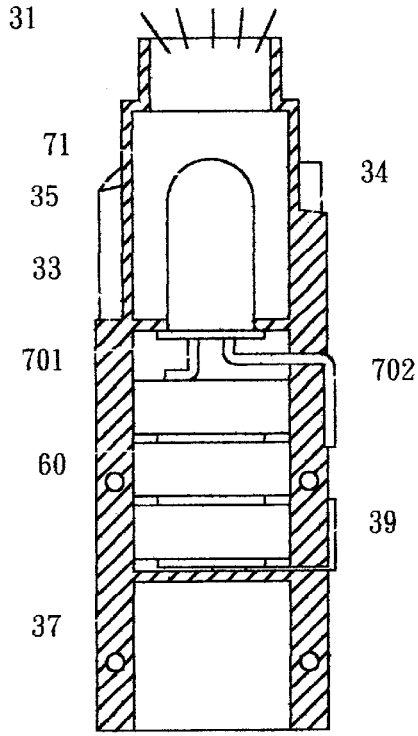
FIG. 10 is a schematic view showing that the battery set of the present invention lights up unidirectionally.
Figure 11:
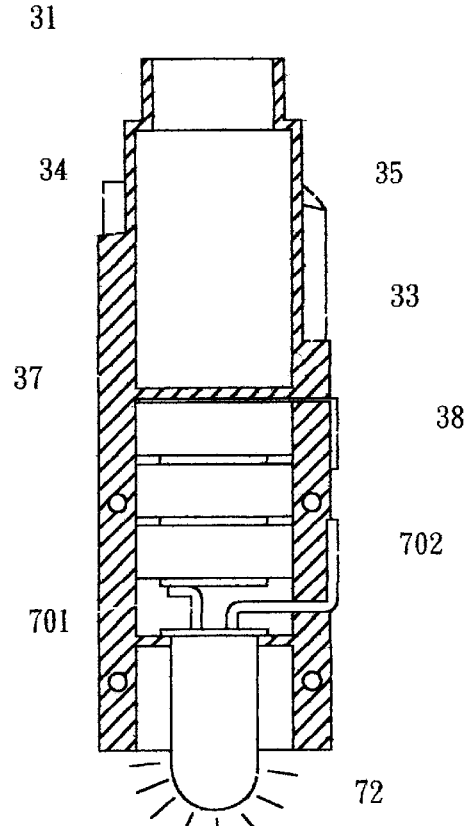
FIG. 11 is a schematic view showing that the battery set of the present invention lights up unidirectionally.

Referring to FIGS. 10 and 11, the light emitting pen of the present invention can be used to light up unidirectionally. For example, in FIG. 11, the battery seat 30 only has the lower light emitting unit 72, but no upper light emitting unit 71, and a top of the battery set 60 is in contact with the upper metal bending piece 38, but a lower end of the battery set 60 has no lower metal bending piece 39. Therefore, when the battery seat 30 of FIGS. 10 and 11 is used to the light emitting pen of the present invention, only upper side or lower side can emit light.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A light emitting pen emitting light bi-directionally comprising:

an upper pen tube having an inner wall, an upper end of the inner wall having a guide;

a lower pen tube mounted to a lower end of the upper pen tube;

a battery seat in the upper pen tube; an upper end of the battery seat being installed with a guiding forward unit;

a press button in the upper pen tube; a lower end of the press button having a guiding out unit; the battery seat being engaged with the press button and being in the guide;

a filler in the lower pen tube; and an expandable spring in the lower pen tube; characterized in that:

a battery set is installed in the battery seat; an positive electrode and a negative electrode are in contact with metal bending pieces at an upper and a lower end of the battery seat; and the two metal bending pieces protrude out of the battery seat and then are bent as an L shape; each of an upper and a lower ends of the battery seat is embedded with an upper light emitting unit and a lower light emitting unit, respectively; a short leg of each light emitting unit is in contact with one electrode of the battery set, and a long leg of each light emitting unit protrudes out of the battery seat and then is bent as a L shape so as to adhere to a wall of the battery seat; the long leg is aligned with, but not in contact with the two metal bending pieces; an inner wall of the upper pen tube has an axial groove; thereby, a metal piece can be guided into the upper pen tube and then is fixed therein; when the battery seat rotates step by step so that when one of the short legs, long legs and the metal bending pieces is in contact with the metal piece of the upper pen tube, one of the upper pen tube or lower pen tube will light up; and a pen head at a lower end of the filler protrudes out or merges into the lower pen tube.

2. The light emitting pen as claimed in claim 1, wherein the battery seat is formed by a left clip seat and a right clip seat; and a wall of one of the clip seat has an opening for taking or place the battery set.

3. The light emitting pen as claimed in claim 1, wherein a cross sectional view of an axial groove has a dovetail shape for guiding a cambered metal piece and then the metal piece is fixed therein firmly.

4. The light emitting pen as claimed in claim 1, wherein a rear end of the filler resists against a spring by a stop hat; and the stop hat resists against the lower pen tube.

5. The light emitting pen as claimed in claim 1, wherein a top of the press button is installed with a transparent cap, and a top of the cap has a convex lens for focusing light.

6. The light emitting pen as claimed in claim 5, wherein a spring is installed between the guiding out unit of the press button and the cap so that as the cap descends, it rises upwards rapidly.

7. A light emitting pen emitting light unidirectionally comprising:

an upper pen tube having an inner wall, an upper end of the inner wall having a guide;

a lower pen tube mounted to a lower end of the upper pen tube;

a battery seat in the upper pen tube; an upper end of the battery seat being installed with a guiding forward unit;

a press button in the upper pen tube; a lower end of the press button having a guiding out unit; the battery seat being engaged with the press button and being in above said guide;

a filler in the lower pen tube; and an expandable spring in the lower pen tube; characterized in that:

a battery set is installed in the battery seat; one electrode of the battery set is in contact with a lower metal bending pieces of the battery seat; and the metal bending piece protrudes out of the battery seat and then is bent as an L shape; an upper end of the battery seat is embedded with a light emitting unit; a short leg of each light emitting unit is in contact with one electrode of the battery set, and a long leg of the light emitting unit protrudes out of the battery seat and then is bent as a L shape so as to adhere to a wall of the battery seat; the long leg is aligned with, but not in contact with the metal bending piece; an inner wall of the upper pen tube has an axial groove; thereby, a metal piece is guided into the upper pen tube and then are fixed therein; when the battery seat rotates step by step so that when one of the short leg, the long leg and the metal bending pieces is in contact with the metal piece of the upper pen tube as rotating the battery seat step by step, the upper pen tube will light up.

8. A light emitting pen emitting light unidirectionally comprising:

an upper pen tube having an inner wall, an upper end of the inner wall having a guide;

a lower pen tube mounted to a lower end of the upper pen tube;

a battery seat in the upper pen tube; an upper end of the battery seat being installed with a guiding forward unit;

a press button in the upper pen tube; a lower end of the press button having a guiding out unit; the battery seat being engaged with the press button and being in above said guide;

a filler in the lower pen tube; and an expandable spring in the lower pen tube; characterized in that:

a battery set is installed in the battery seat; one electrode of the battery set is in contact with an upper metal bending pieces of the battery seat; and the metal bending piece protrudes out of the battery seat and then is bent as an L shape; a lower end of the battery seat is embedded with a lower light emitting unit; a short leg of each light emitting unit is in contact with another electrode of the battery set, and a long leg of the light emitting unit protrudes out of the battery seat and then is bent as an L shape to as to adhere to a wall of the battery seat; the long leg is aligned with, but not in contact with the metal bending piece; an inner wall of the upper pen tube has an axial groove; thereby, a metal piece is guided into the upper pen tube and then are fixed therein; when the battery seat rotates step by step so that when one of the short leg, the long leg and the metal bending pieces is in contact with the metal piece of the upper pen tube as rotating the battery seat step by step, the lower pen tube will light up.

* * * * *